United States Patent [19]

Read

[11] 4,134,455

[45] Jan. 16, 1979

[54] OILWELL TUBING TESTER WITH TRAPPED VALVE SEAL

[75] Inventor: Norman W. Read, Dallas, Tex.

[73] Assignee: Dresser Industries, Inc., Dallas, Tex.

[21] Appl. No.: 806,568

[22] Filed: Jun. 14, 1977

[51] Int. Cl.[2] ..... E21B 43/12

[52] U.S. Cl. ..... 166/334; 251/363

[58] Field of Search ..... 166/332, 319, 321, 324, 166/325, 334; 251/360, 363; 175/242

[56] References Cited

U.S. PATENT DOCUMENTS

| | | | |
|---|---|---|---|
| 2,853,265 | 9/1958 | Clark, Jr. | 251/106 |
| 2,874,927 | 2/1959 | Conrad | 251/100 |
| 2,912,216 | 11/1959 | Conrad | 251/100 |
| 2,952,438 | 9/1960 | Conrad et al. | 251/348 |
| 3,016,914 | 1/1962 | Keithahn | 166/325 |
| 3,421,733 | 1/1969 | Stewart, Jr. | 251/363 |
| 3,526,278 | 9/1970 | Scott | 166/334 X |
| 3,724,501 | 4/1973 | Scott | 166/321 |
| 3,826,309 | 7/1974 | Tausch | 166/319 |

OTHER PUBLICATIONS

Technical Manual, Baker Oil Tools, Inc., Index 320, Unit No. 3165, dated 9/15/73.

*Primary Examiner*—Ernest R. Purser
*Attorney, Agent, or Firm*—Richard M. Byron

[57] ABSTRACT

An oilwell tubing tester for the in-place pressure-testing of oilwell tubing strings for leaks, utilizes a flapper valve, a valve seat, a three-piece sealing mechanism, and a sliding J-mandrel located inside the tester housing in abutting relationship with the flapper valve.

5 Claims, 6 Drawing Figures

OILWELL TUBING TESTER WITH TRAPPED VALVE SEAL

BACKGROUND OF THE INVENTION

The present invention discloses a well tool for use in a tubing string suspended in a well bore and more particularly involves a tubing testing tool for allowing a pressure-test to be performed on the tubing string to determine if the string has leaks therein.

Prior art tubing testers such as those disclosed in U.S. Pat. Nos. 3,329,007; 2,874,927; and 2,853,625 all generally comprise a spring-loaded flapper valve hingedly secured inside a housing and engageable with a valve seat therein. A sliding tubular mandrel is located inside the housing and arranged to abut the flapper valve and pivot it open in the housing, thereby communicating the housing bore with the bore of the tubular mandrel. One of the most critical areas of operation in the tubing tester primarily involves the mating surfaces of the valve seat and the flapper valve. The sealing surfaces between these two components are critical to the tool's operation and must be able to withstand the erosion and high pressures of fluids and fluid-solid slurries normally flowing through the tubing string.

The sealing ability of the flapper valve on its seat usually depends solely on a single circular sealing element made of an elastomeric substance and usually either bonded to either the flapper or the seat, or else trapped in a dovetail channel cut in the flapper or the valve seat.

Both of these prior art methods of providing seal elements suffer from serious disadvantages. The bonded seal is expensive to manufacture and is almost always unreliable because of the difficulty in obtaining good, tough 100% rubber-to-metal bonds. This seal method also suffers the disadvantage that when the seal must be replaced, the tool must be pulled out of the string, disassembled, and the flapper or valve seat returned to the bonding lab to have a new seal bonded thereon.

The alternate method is to machine a peripheral dovetail groove in the valve face or the valve seat face and force an elastomeric seal into the dovetail channel. The disadvantage of this method is that the seal must be small enough to allow entry into the groove without cutting or damaging the seal material. Under these circumstances, the seal then is highly susceptible to extrusion under pressure and being sucked out of place during high velocity fluid flow.

The present invention solves these two problems by providing a tubing tester construction which utilizes an easily replaceable seal element in a seal channel, which element does not have to be forced into the channel yet is held securely enough to prevent extrusion or velocity removal.

DESCRIPTION OF THE PREFERRED EMBODIMENTS

Figure 1:
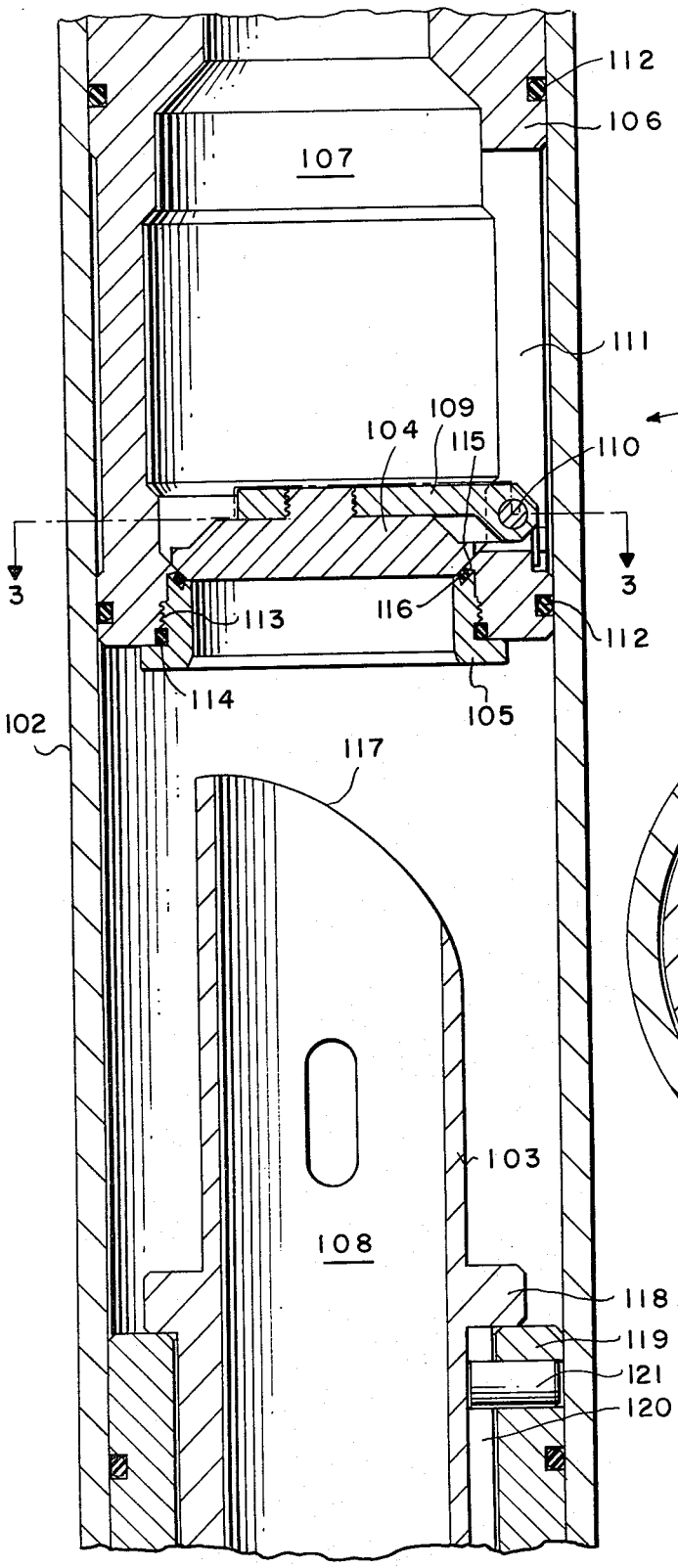
FIG. 1 is a cross-sectional illustration of the tubing tester taken along the longitudinal axis.

Referring to FIG. 1, the tubing tester 101 is illustrated in partial longitudinal cross-section. The tool generally comprises a tubular housing 102 containing a J-slot mandrel 103 slidably mounted within the housing and a flapper valve 104 hingedly mounted in a valve seal sleeve 106. The flapper valve 104 provides a valving action between the open bore 107 of sleeve 106 and the open bore 108 of sliding mandrel 103.

Valve 104 is threadedly engaged in a hinged arm 109 which is pivotally connected at 110 to sleeve 106. Sleeve 106 has an opening 111 cut in the wall thereof to permit full opening of valve 104 by allowing pivotal movement of the valve 104 and arm 109 into the opening area 111. Sleeve 106 is threadedly attached to housing 102 at its upper end (not shown) and contains O-ring seals 112 above and below flapper valve 104 to seal against housing 102.

A seal retainer ring 105 is threadedly engaged in the lower end of sleeve 106 by threads 113, and a ring seal 114 provides a fluid tight seal therebetween. Ring 105 coacts with sleeve 106 to provide a seal groove 115 for receiving a circular valve seal 116.

Sliding mandrel 103 is provided with an arcuate engagement surface 117 at its upper end for engagement with flapper valve 104. Ring 105 is sized and located to allow easy passage of mandrel 103 therethrough. Mandrel 103 further has an external abutment shoulder 118 formed thereon and arranged to abut a stationary abutment collar 119. Mandrel 103 has a J-slot channel 120 cut in the external wall thereof and collar 119 has an inwardly extending J-pin 121 embedded therein and arranged to project into engagement with J-slot channel 120.

Figure 3:
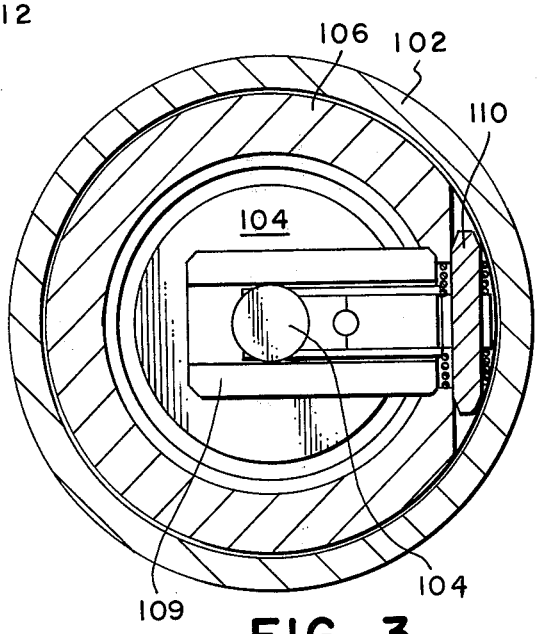
FIG. 3 is an axial cross-sectional view taken at line 3—3 of FIG. 1.

FIG. 3 is an axial cross-sectional view of the tubing tester 101 taken along broken line 3—3 of FIG. 1. FIG. 3 illustrates the relationship between the housing 102, the valve seat sleeve 106, the flapper valve 104 and the hinged arm 109.

Figure 2:
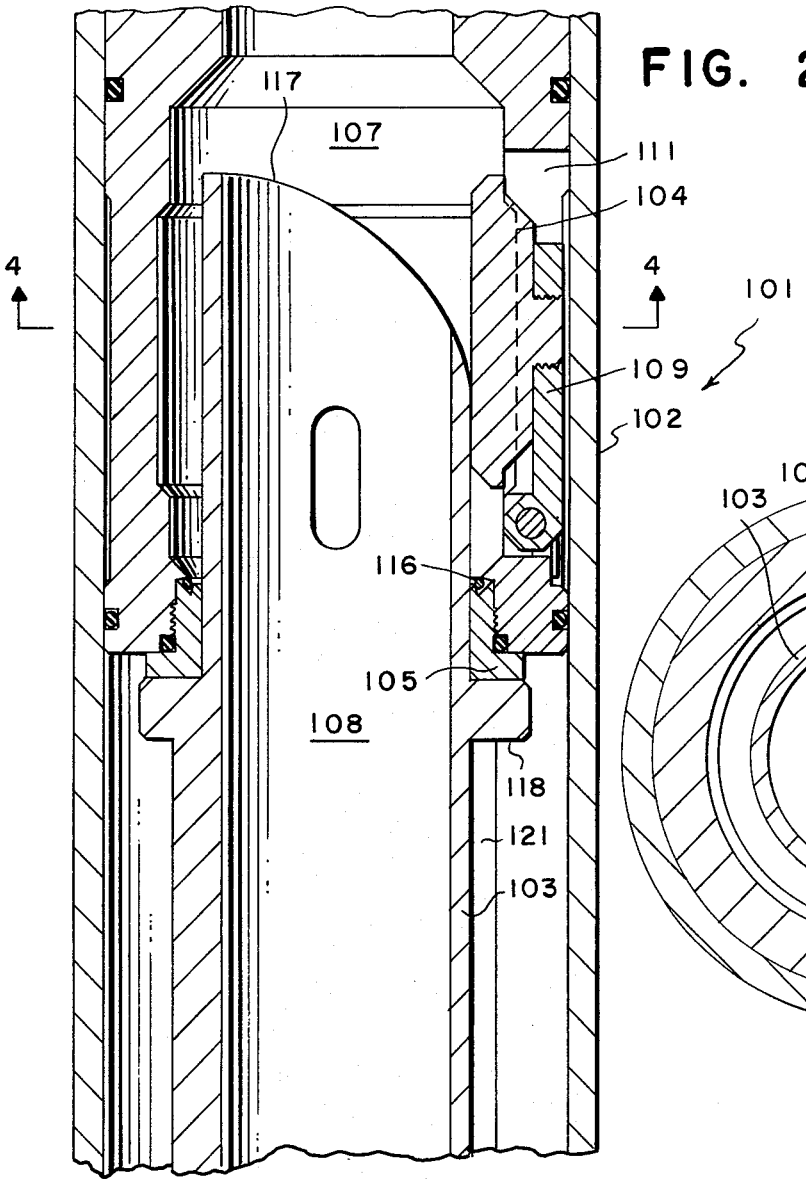
FIG. 2 is a cross-sectional illustration of the tubing tester of FIG. 1 in a different operation position.

FIG. 2 is a longitudinal cross-sectional view of the tubing tester in the open flowing orientation wherein mandrel 103 has been telescoped upward through ring 105 until flapper valve 104 has been pivoted into opening 111 by the camming action of surface 117. Upon abutment of shoulder 118 with ring 105, bore 108 will be in full flowing communication with bore 107 and valve 104 will be pivoted 90° out of the flow passage area.

Figure 4:
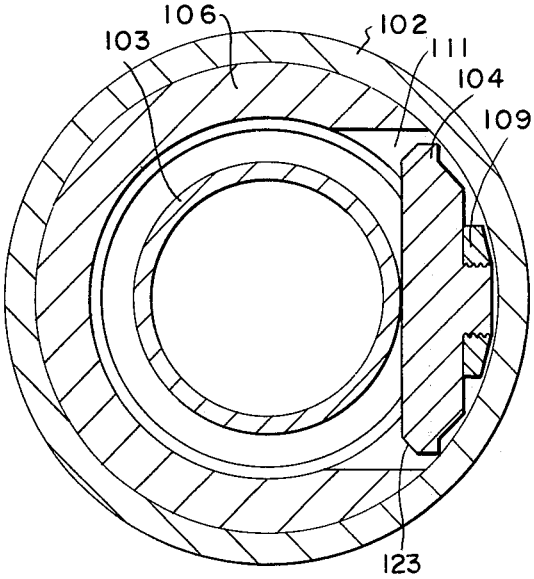
FIG. 4 is an axial view of the invention taken at line 4—4 of FIG. 2.

FIG. 4 is a cross-section view of the tubing tester in the full open position and is taken at line 4—4 of FIG. 2. FIG. 4 illustrates the new orientation of the housing 102, the valve seat sleeve 106, the sliding mandrel 103 and the flapper valve 104.

Figure 5:
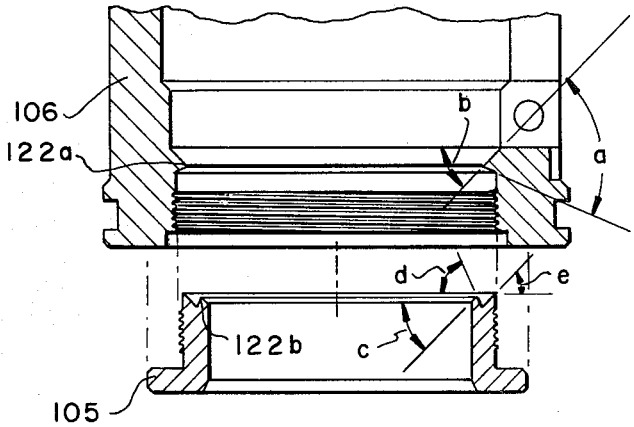
FIG. 5 is a close-up view of the seal receiver assembly.

FIG. 5 is a close-up illustration of a portion of the tubing tester shown in disassembled form. In FIG. 5, the lower end of the valve seat sleeve 106 is illustrated with the seal retainer ring 105 removed therefrom for better clarity. The lower end of the valve seat sleeve 106 contains an inwardly projecting angular annular shoulder **122*a* formed therein. This shoulder provides a portion of the tapered valve seat for receiving in sealing engagement the tapered valve surface 123 of flapper valve 104** (see FIG. 4).

The lower surface of shoulder **122*a*** forms an angle *a* with a plane perpendicular to the central longitudinal axis of the tubing tester. The upper surface of shoulder 122a forms an angle *b* with the same perpendicular plane. The retainer ring 155 has a notched upper end with an inner angular ridge 122b formed by said notch. The inward surface of ridge 122b forms an angle c with the inner surface of ring 105 which in turn is generally parallel to the central longitudinal axis of the tool. The opposite surface of ridge 122b forms an angle *d* with the perpendicular plane mentioned above. The remaining surface of the V-groove formed in top of ring 105 forms an angle *e* with the same perpendicular plane.

The angles c and *d* generally are complimentary angles, thus insuring that the top surface of shoulder 122a and the inner most surface of ridge 122b are approximately coplanar thus providing a continuous valve seat surface. The angle e is approximately equivalent to the angle b, thus providing a generally parallel relationship between the valve seating surface on 122a and 122b with the bottom of the seal channel 115 formed when ring 105 is threadedly engaged in sleeve 106. This channel is formed by the close proximity of ridge 122b with shoulder 122a when retaining ring 105 is threaded completely into sleeve 106.

The walls of the resulting seal channel formed therebetween converge as they move radially inward. The angle of convergence results from the difference between angle a and angle d. The specific values of angles a through d may be varied to obtain different dovetail channel dimensions and different valve seating angles. For instance, angle a can be from 45° to about 66°; angle b can vary from about 0° up to about 75°; angle c can vary from about 0° to about 75°; angle d can be from 39° up to about 135°; and angle e can be from 0° to about 75°. In one embodiment, the following angles were found to be satisfactory: a was 66°, b was 45°, c was 45°, d was 69°, and e was 45°. This set of angles produced a dovetail channel having converging sidewalls which, if extended to intersection, would form an angle of 48°. Thus in operation, the critical sealing element 116 is located in the tubing tester during assembly by placing the elastomeric circular seal in the V-groove atop retainer ring 105.

Ring 105 is then threaded into sleeve 106 until it is tightly engaged in full threaded relationship therein. Ring 116 is then effectively trapped in a dovetail channel formed between shoulder 122a and ridge 122b. Since the channel is closed up on the ring rather than in the prior art devices where the channel is formed in a single solid piece, the O-ring may be sized sufficiently to almost completely fill the volume of the dovetail channel and still have a portion extending out of the channel for sealing engagement with the flapper valve surface 123.

Figure 6:
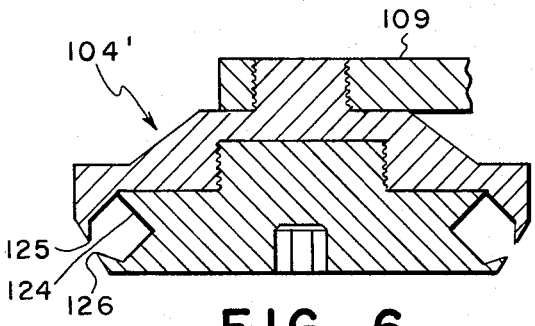
FIG. 6 is a partial cross-sectional enlargement of a seal channel.

FIG. 6 is an enlarged broken-out cross-sectional view of an alternate dovetail channel configuration having additional angular lips 125 and 126, angled inward toward the channel area, and formed at the upper ends of the channel walls. Lips 125 and 126 provide even additional positive entrapment of the seal member in the compound dovetail channel.

In addition to these lips, it should be noted that the dovetail channel 124 is formed in the flapper valve member 104', which is an alternative to putting the seal and dovetail channel in the valve seat. This is accomplished by forming the flapper valve of two conjoining sections, connectable by means such as threads, with each section providing a portion of the dovetail channel.

The prior art devices cannot obtain this efficient valve to channel fitting because of the necessity of pushing the valve seal through the restricted opening of the dovetail channel into the large base area of the channel. The present invention eliminates this disadvantage by providing the above described composite channel assembly wherein the dovetail channel is formed around a circular seal rather than forming the dovetail channel first and then attempting to insert the seal.

Thus, the present invention provides a tubing tester construction having a generally circular flapper valve with a tapered valve seat thereon engageable in a composite valve seating surface having a multi element dovetail seal channel formed therein which provides an optimum-sized sealing element in the valve seat surface. Although a specific preferred embodiment of the present invention has been described in the detailed description above, the description is not intended to limit the invention to the particular forms of embodiments disclosed therein since they are to be recognized as illustrative rather than restrictive and it will be obvious to those skilled in the art that the invention is not so limited. For example, whereas the present invention is described as a tubing tester oilwell tubing strings, it is clear that the present invention could be utilized in other devices which feature the flapper valve type of arrangement. Thus the invention is declared to cover all changes and modifications of the specific example of the invention herein disclosed for purposes of illustration which do not constitute departures from the spirit and scope of the invention.

The embodiments of the invention in which an exclusive property or privilege is claimed are defined as follows:

1. A tubing tester for placement in tubing strings in an oilwell borehole to test for pressure leaks in said tubing springs; said tester comprising:

(a) an elongated tubular housing;

(b) a cylindrical tubular mandrel means telescopically mounted in said housing;

(c) pivotable valve means in said housing arranged for closing off the inner bore of said housing, said pivotable valve means including a pivotally mounted valve element having a frustoconically shaped sealing surface;

(d) valve seal means rigidly mounted in said housing below said valve element;

(e) said mandrel means having an abutment surface thereon arranged to abut said valve element and pivot it to open the bore of said housing to the bore of said mandrel means;

(f) said valve seat means includes an annular seal surface matingly engageable with said valve element sealing surface and having an annular pocket around a mid-portion of said seal surface to receive and mount an annular elastomeric seal, said seal pocket being generally cross-sectionally triangularly shaped and having annular in-turned lips on opposed edges thereof extending sufficiently to effectively trap said seal element within the confines of said pocket with a portion of said seal element extending out of said seal pocket for sealing engagement with said pivotable valve means sealing surface; and (g) said housing has a sleeve threadedly mounted below said annular seal surface such that an upper portion of said sleeve forms a lower side of said pocket which provides for easy installation and removal of said seal element by installation and removal of said threadedly mounted sleeve.

2. The tubing tester of claim 1, wherein (a) said housing has an inwardly extending shoulder in said bore forming an upper side of said annular pocket; and (b) said sleeve has a notched upper end arranged to fit in close proximity to said annular shoulder thereby forming said pocket in a cross-sectional dovetail channel configuration for retaining said seal element.

3. In a well tool having a housing, a flapper valve assembly, and an opening mandrel telexcopically mounted in the housing for opening a flapper valve element, the improvement comprising:

(a) seal means in said flapper valve assembly, said seal means comprising an annular valve seat assembly including a frustoconically shaped valve seat surface arranged for mating engagement with corresponding shaped surface on said flapper valve element when said flapper valve element is in a lowered and closed position, an elastomeric seal element mounted in a seal pocket around a mid-portion of said seat surface, a seal retainer sleeve threadedly mounted in said housing from below said flapper valve with an upper end portion of said retainer sleeve forming one side of said seal pocket thereby permitting installation and removal of said seal element by mounting and removal of said retainer sleeve; and (b) said seal pocket having a cross-sectionally dovetailed configuration defined by opposed sides and a bottom wherein said bottom is inclined substantially at the same altitude as said frustoconically shaped valve seat surface and said opposed sides have in-turned lips in order to effectively trap and retain said seal element within said seal pocket and to prevent such from being extruded from said seal pocket upon opening said flapper valve when it is subject to a substantial pressure differential.

4. The well tool of claim 3 wherein said valve seat assembly and said retainer sleeve conjointly for said dovetail seal pocket for retaining said seal element.

5. The well tool of claim 3, wherein:

(a) said housing has an inner annular shoulder extending transverse to the bore of said housing and forming an upper side of said seal pocket; and (b) said retainer sleeve has a groove around an upper end thereof arranged to be placed in close proximity to said annular shoulder wherein said annular shoulder and said groove form said dovetail seal pocket having inclined sides, a bottom connecting said sides at one end, and an open top through which a portion of said seal element protrudes in order to sealingly engage said flapper valve element.

* * * * *